US007399567B2

(12) United States Patent
Kadokura et al.

(10) Patent No.: US 7,399,567 B2
(45) Date of Patent: Jul. 15, 2008

(54) TONER FOR ELECTROSTATIC LATENT IMAGE DEVELOPMENT, ELECTROSTATIC LATENT IMAGE DEVELOPER CONTAINING THE TONER, AND IMAGE FORMATION METHOD USING THE DEVELOPER

(75) Inventors: Yasuo Kadokura, Kanagawa (JP); Masakazu Iijima, Kanagawa (JP); Tomohito Nakajima, Kanagawa (JP); Satoshi Yoshida, Kanagawa (JP); Michio Take, Kanagawa (JP); Takao Ishiyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 419 days.

(21) Appl. No.: 11/149,327

(22) Filed: Jun. 10, 2005

(65) Prior Publication Data

US 2006/0177757 A1 Aug. 10, 2006

(30) Foreign Application Priority Data

Feb. 9, 2005 (JP) ..... 2005-033149

(51) Int. Cl.
*G03G 9/00* (2006.01)

(52) U.S. Cl. ..... 430/110.4; 430/111.4; 430/111.41; 430/108.3; 430/124.1

(58) Field of Classification Search ..... 430/110.4, 430/111.4, 111.41, 108.3, 124.1
See application file for complete search history.

(56) References Cited

U.S. PATENT DOCUMENTS 6,447,969 B1 * 9/2002 Ito et al. ..... 430/106.3

FOREIGN PATENT DOCUMENTS

| | | |
|---|---|---|
| JP | A 02-240663 | 9/1990 |
| JP | A 03-105350 | 5/1991 |
| JP | A 07-104514 | 4/1995 |
| JP | A 08-171234 | 7/1996 |
| JP | A 08-328311 | 12/1996 |
| JP | A 09-230628 | 9/1997 |
| JP | A 2002-123038 | 4/2002 |
| JP | A 2002-131980 | 5/2002 |

* cited by examiner

*Primary Examiner*—Mark A Chapman
(74) *Attorney, Agent, or Firm*—Oliff & Berridge, PLC

(57) ABSTRACT

A toner for electrostatic latent image development containing at least a binder resin and a colorant, wherein [Fe]/[C] satisfies the following formula (1) where [C] indicates the carbon content (%) and [Fe] indicates the iron content (%) of the toner determined through X-ray fluorescence analysis, $$0.00005 \leqq [Fe]/[C] \leqq 0.0002. \quad (1)$$

18 Claims, No Drawings

TONER FOR ELECTROSTATIC LATENT IMAGE DEVELOPMENT, ELECTROSTATIC LATENT IMAGE DEVELOPER CONTAINING THE TONER, AND IMAGE FORMATION METHOD USING THE DEVELOPER

BACKGROUND OF THE INVENTION

1. Technical Field of the Invention

The present invention relates to a toner for electrostatic latent image development and an electrostatic latent image developer for electrophotographic devices (for image formation device) such as duplicator, printer and facsimile that are driven according to an electrophotographic process.

The invention also relates to a image formation method.

2. Description of the Related Art

Impurities especially aromatic ingredients with low-molecular weight in toner for electrostatic image development (hereinafter this may be simply referred to as "toner") that is used in a method of visualization of image information via electrostatic image formation through electrophotography cause some problems in that they often give an offensive odor when toner is used or when a toner container is opened. For toner fixation on copy paper, known are a pressure fixation method and a thermal fixation method. The thermal fixation method includes, for example, oven fixation, flash fixation, pressure fixation, hot roller fixation. In general, hot roller fixation is widely used in electrophotographic duplicators, etc. The method enjoys an extremely high thermal efficiency in fusing a toner image onto a sheet on the surface of a hot roller, and it enables rapid image fixation and is extremely effective in rapid image duplication.

However, the method includes heating a toner image, in which, therefore, minor ingredients in the toner may be released in the air to give an offensive odor to users. With recent down-sizing of duplicators and printers in the art, there is much increasing the opportunity of using them near workers in offices. In addition, there is also increasing the opportunity of using them in ordinary homes. As a result, there are increasing problematic cases where the offensive odor released from toner gives an unpleasant feeling to users. The odor level organoleptically detectable by man is 0.1 ppm or less, and is extremely low.

One cause of offensive odor from electrophotographic devices is ozone generation through corona discharging in the devices, but the ozone smell has been drastically reduced by technological innovation to provide contact charging such as roller charging or brush charging or provide improved corona dischargers capable of preventing ozone generation as much as possible and, as a result, other cases have relatively increased where the toner smell caused by toner gives an unpleasant feeling. A filter or the like to adsorb ozone and odor may be fitted to the body of electrophotographic devices, which, however, is disadvantageous in point of production costs and is troublesome as requiring periodic exchange for its deodorizing function maintenance.

Another method heretofore known for reducing the odor from toner includes reducing the impurities in the binder resin in toner. For example, JP-A-8-328311 proposes odor reduction through reduction in the monomer remaining the binder resin. On the other hand, JP-A-7-104514 says that the reduction in the volatile component in resin is not enough for odor level reduction since the chemically-unstable substance existing as a minor component in the starting material for toner is decomposed during toner production and the resulting volatile substance causes the generation of an offensive odor from toner, and it discloses a technique of removing the odor of the starting material as a measure to solve the odor problem with the final product toner.

JP-A-8-171234 says that the substance to cause odor is an oxidation product of benzaldehyde in toner, and discloses a method of reducing the benzaldehyde content of toner. On the other hand, JP-A-9-230628 discloses a method of reducing the amount of alkylmercaptan (this is one of odor-releasing substances in toner), which is a molecular weight-controlling agent for resin and is indispensable to the basic properties of toner, to the lowermost level necessary for toner so as to prevent odor generation from toner while preventing the toner fixation capability from being worsened.

JP-A-3-105350 discloses a method of adding an alkylbetaine compound to toner in which the compound reacts with odor substances and adsorb them; JP-A-2002-123038 discloses a method of adding any of phyton-cides, catechins or metal phthalocyanines to toner; and JP-A-2002-131980 discloses adding any of macrocyclic lactones or macrocyclic ketone compounds to toner for the purpose of neutralizing the odor of the chain transfer agent in toner resin. In these, however, the compound added inevitably adsorbs some other effective toner component because of its structure, therefore often resulting in that it detracts from the basic quality such as the charging property of toner. JP-A-2-240663 discloses a method of toner deodorization, which includes keeping toner in contact with a deodorant for 5 hours or more in a step of grinding and classifying toner particles. However, the method is still problematic in that it takes a long time to produce toner and it could not always sufficiently reduce the odor of the produced toner.

SUMMARY OF THE INVENTION

The present invention provides a toner for electrostatic latent image development of which the advantages are that the generation of odor from the toner is reduced and the toner is therefore free from a problem of odor. Specifically, the present invention is as follows:

A toner for electrostatic latent image development containing at least a binder resin and a colorant, wherein [Fe]/[C] satisfies the following formula (1) where [C] indicates the carbon content (%) and [Fe] indicates the iron content (%) of the toner determined through X-ray fluorescence analysis:

$$0.00005 \leqq [Fe]/[C] \leqq 0.0002 \quad (1).$$

DETAILED DESCRIPTION OF THE INVENTION

We, the present inventors have found that, when a toner for electrostatic latent image development containing at least a binder resin and a colorant satisfies the following formula (1) in point of the ratio of [Fe]/[C] therein where [C] indicates the carbon content (%) and [Fe] indicates the iron content (%) of the toner determined through X-ray fluorescence analysis, $$0.00005 \leqq [Fe]/[C] \leqq 0.0002 \quad (1),$$

then the toner odor can be reduced.

The invention is described in detail hereinunder.

The main ingredient of toner used in visualization of image information via electrostatic images through electrophotography is a binder resin. The binder resin that may be used in the toner for electrostatic latent image development of the invention includes, for example, ethylenic resins such as polyethylene, polypropylene; styrenic resins such as polystyrene, α-polymethylstyrene; (meth) acrylic resins such as polymethyl methacrylate, polyacrylonitrile; polyamide resins, polycarbonate resins, polyether resins, polyester resins; and their copolymer resins. In view of the charging stability and the development durability of the toner for electrostatic latent image development, preferred for the binder resin are styrenic resins, (meth)acrylic resins, styrene-(meth) acrylic copolymer resins and polyester resins.

Various methods may be employable for producing the binder resins. For example, styrenic resins, (meth)acrylic resins and styrene-(meth) acrylic copolymer resins may be produced through radical polymerization. In that case, in general, a thiol component-having compound may be used as the chain transfer agent. The thiol component-having compound is a sulfur-containing compound, and it causes an offensive odor. In addition, when a nitrogen compound is used as a polymerization initiator, then this also causes an offensive odor.

In the invention, the problems can be solved by adding a suitable amount of a divalent iron ion in the process of toner production. This is because the divalent iron ion has a strong reducing ability and changes the sulfur-containing compounds and nitrogen-containing compounds that cause an offensive odor.

Polyester resins may be produced from the above-mentioned polymerizing monomer components by combining them in any desired manner according to conventional known methods, for example, as in *Polycondensation* (by Kagaku Dojin, 1971); *Polymer Experimental Studies* (Polycondensation and Polyaddition) (by Kyoritsu Publishing, 1958); and *Polyester Resin Handbook* (by Nikkan Kogyo Shinbun, 1988). Briefly, they may be produced though interesterification or direct polycondensation alone or as combined. In their production, aldehyde-type substances may be co-produced as side reaction products, and these cause an offensive odor. The divalent iron ion used in the toner of the invention has a strong reducing ability and can decompose the aldehyde-type substances, therefore solving the cause of the offensive odor.

<Divalent Iron Ion>

In the invention, a minor amount of a divalent iron ion is added to the toner being produced, and the toner is prevented from releasing an offensive odor. As so mentioned hereinabove, the divalent iron ion has a strong reducing ability, and can change or decompose odor-releasing compounds such as sulfur-containing compounds, nitrogen-containing compounds and aldehyde-type substances to be in a binder resin, therefore deodorizing them. The divalent iron compound used for reducing odor-releasing compounds changes into a trivalent iron compound in the toner. The divalent iron ion added is taken in the toner. The preferred amount of the divalent iron ion to be added to the toner is determined by the ratio of the carbon content [C] to the iron content [Fe] of the toner. Concretely, it is determined as follows: $0.00005 \leqq [Fe]/[C] \leqq 0.0002$. The amount of the chain transfer agent and the polymerization initiator is extremely minor, as compared with the amount of the finally-produced binder resin, or that is, the amount of the odor-releasing compounds such as sulfur-containing compounds, nitrogen-containing compounds, aldehyde-type substances is extremely minor. Accordingly, the divalent iron ion for deodorizing them may exhibit its effect even though its amount is extremely minor. If the iron ion amount added is large, then it may have some negative influence on the viscoelasticity of toner and will detract from the transparency of OHP. Since black toner does not require an aptitude for OHP, a larger amount of a divalent iron ion than in the above-mentioned range may be added to it, for example, as in the following formula (2):

$$0.00005 \leqq [Fe]/[C] \leqq 0.005 \quad (2).$$

A major part of molecules to constitute toner are of a binder resin, and most of them are formed of carbon and hydrogen atoms. From the atomic weight of carbon and hydrogen, it may be considered that the weight of toner is the amount of carbon. The amount of iron ion is represented as a ratio thereof to the amount of carbon, and when $0.00005 \leqq [Fe]/[C] \leqq 0.0002$ is satisfied, then the odor problem may be solved and a toner having an aptitude for OHP can be produced.

The carbon content [C] % and the iron content [Fe] % of toner are determined through X-ray fluorescence analysis.

X-ray fluorescence analysis is described. The sample to be analyzed is pretreated. Concretely, 6 g of a toner is shaped in a mode of compression molding under a pressure of 10 tons for 1 minute by the use of a pressure mold. Then, using a fluorescent X-ray device (Shimadzu's XRF-1500), this is analyzed. Regarding the condition, the tube voltage is 40 KV, the tube current is 90 mA, and the time for analysis is 30 minutes.

A divalent iron ion is used in the invention. When a divalent iron compound is used, then it is desirable that a solution of the compound in water is added to the toner being produced in order that the iron ion may be uniformly dispersed in the toner. Accordingly, the iron compound for use in the invention is preferably a water-soluble divalent iron compound. Specific examples of the iron compound are iron(II) chloride, iron(II) bromide, iron(II) nitrate, iron(II) bicarbonate, iron(II) acetate, iron(II) oxalate.

<Toner for Electrostatic Latent Image Development>

The toner for electrostatic latent image development of the invention contains at least a binder resin, a colorant and iron, optionally further containing wax and any other component. A divalent iron ion is added to the toner for electrostatic latent image development of the invention while the toner is produced, and this solves the odor problem.

<Method of Toner Production>

The method for producing the toner for electrostatic latent image development of the invention is not specifically defined, for which, for example, employable is any method of kneading and grinding, emulsion polymerization and aggregation or suspension polymerization. Especially preferred is a method of emulsion polymerization and aggregation. In the invention, a divalent iron ion must be uniformly dispersed inside the toner. In a kneading and grinding method, a divalent iron ion could not be uniformly dispersed during kneading. In a suspension polymerization method, a polymerizing monomer is generally an organic compound and a divalent iron ion could not uniformly react with it.

Contrary to these, a method of emulsion polymerization and aggregation is advantageous in that a divalent iron ion can be uniformly added to the system when a dispersion of binder resin particles having a particle size of at most 1 μm and a dispersion of a colorant are mixed, and therefore the method solves the above-mentioned problems. The uniformly-dispersed binder resin particles and the colorant are aggregated in a step of aggregating them into particles having a toner particle size. After the aggregation step, the aggregated particles are heated up to a temperature not lower than the glass transition point of the binder resin particles, and are thereby fused to form toner particles.

In the aggregation step, the particles in the binder resin dispersion, the colorant dispersion and optionally a lubricant dispersion are aggregated to form aggregated particles. The aggregated particles are formed through hetero-aggregation, and an ionic surfactant having a opposite polarity to the aggregated particles or a monovalent or more polyvalent charged compound such as a metal salt may be added to them for the purpose of stabilizing the aggregated particles or for controlling the particle size/particle size distribution thereof.

In the fusing step, the resin particles in the aggregated particles are fused at a temperature not lower than the glass transition point thereof, and the aggregated particles therefore change from amorphous to spherical. Next, the aggregated particles are separated from the aqueous medium and optionally washed and tried to give toner particles.

The volume-average particle size of the toner is preferably from 2 to 10 μm or so, more preferably from 3 to 8 μm or so, even more preferably from 4 to 6 μm or so.

The particle size distribution of the toner is preferably as narrow as possible. More concretely, GSDp, the square root of a ratio of D84p/D16p represented by the following formula is preferably at most 1.23, $$GSDp=\{(D84p)/(D16p)\}^{0.5}$$

where D16p indicates the diameter of 16% particles, and D84p indicates the diameter of 84% particles (84% diameter) both counted from smallest particles. More preferably, GSDp is 1.21 or so.

If both the volume-average particle size and DSPs are outside the above-mentioned ranges, then image transfer with the toner in electrophotography may be difficult.

Preferably, the sphericity factor SF1 of the toner falls within a range of from 110 to 140, more preferably from 120 to 140. As so mentioned hereinabove, it is known that spherical toner is more readily transferred in the transfer step in electrophotography but amorphous toner is more readily cleaned off in the cleaning step therein.

The toner sphericity factor SF1 is a profile factor of toner indicating the degree of surface roughness of toner particles, and this is represented by the following formula:

$$SF1=(ML)^2/A\times\pi/4\times100$$

where ML indicates the maximum length of a toner particle; and A indicates the projected area of the toner particle.

<Binder Resin>

The binder resin for use in the toner for electrostatic latent image development of the invention includes, for example, ethylenic resins such as polyethylene, polypropylene; styrenic resins such as polystyrene, poly(α-methylstyrene); (meth)acrylic resins such as polymethyl methacrylate, polyacrylonitrile; polyamide resins, polycarbonate resins, polyether resins, polyester resins; and their copolymer resins. In view of the charging stability and the development durability of the toner for electrostatic latent image development, preferred for the binder resin are styrenic resins, (meth)acrylic resins, styrene-(meth)acrylic copolymer resins and polyester resins.

Other polymerizing monomers usable for the polyester resins are di, tri or more polycarboxylic acids and di-, tri or more polyalcohols that are polymerizing monomer components heretofore known in the art, for example, as in *Polymer Data Handbook*, primary edition (by the Polymer Society of Japan, Baifukan). Specific examples of those polymerizing monomer components are mentioned below. Dicarboxylic acids are, for example, dibasic acids such as succinic acid, glutaric acid, adipic acid, suberic acid, azelaic acid, sebacic acid, phthalic acid, isophthalic acid, terephthalic acid, naphthalene-2,6-dicarboxylic acid, naphthalene-2,7-dicarboxylic acid, cyclohexanedicarboxylic acid, malonic acid, mesaconic acid, and their anhydrides and lower alkyl esters; and aliphatic unsaturated dicarboxylic acids such as maleic acid, fumaric acid, itaconic acid, citraconic acid. Tri and more polycarboxylic acids are, for example, 1,2,4-benzenetricarboxylic acid, 1,2,5-benzenetricarboxylic acid, 1,2,4-naphthalenetricarboxylic acid, and their anhydrides and lower alkyl esters. One or more of these may be used herein either singly or as combined.

Dialcohols are, for example, bisphenol A, hydrogenated bisphenol A, bisphenol A with ethylene oxide and/or propylene oxide adduct, a,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol, 1,9-nonanediol, neopentyl glycol. Tri or more polyalcohols are, for example, glycerin, trimethylolethane, trimethylolpropane, pentaerythritol. One or more of these may be used herein either singly or as combined. If desired, a monoacid such as acetic acid or benzoic acid, or a monoalcohol such as cyclohexanol or benzyl alcohol may also be used for the purpose of controlling the acid value or the hydroxyl value of the binder resin.

Polyester resins may be produced from the above-mentioned polymerizing monomer components by combining them in any desired manner according to conventional known methods, for example, as in *Polycondensation* (by Kagaku Dojin, 1971); *Polymer Experimental Studies* (Polycondensation and Polyaddition) (by Kyoritsu Publishing, 1958); and *Polyester Resin Handbook* (by Nikkan Kogyo Shinbun, 1988). Briefly, they may be produced though interesterification or direct polycondensation alone or as combined.

The polymerizing monomers to constitute the above-mentioned styrenic resins, (meth)acrylic resins and their copolymer resins are described. The styrenic monomers are, for example, styrene, α-methylstyrene, vinylnaphthalane; alkyl chain-having alkyl-substituted styrenes such as 2-methylstyrene, 3-methylstyrene, 4-methylstyrene, 2-ethylstyrene, 3-ethylstyrene, 4-ethylstyrene; halostyrenes such as 2-chlorostyrene, 3-chlorostyrene, 4-chlorostyrene; fluorostyrenes such as 4-fluorostyrene, 2,5-difluorostyrene. The (meth) acrylic acid-type monomers are, for example, (meth)acrylic acid, n-methyl (meth)acrylate, n-ethyl (meth)acrylate, n-propyl (meth)acrylate, n-butyl (meth)acrylate, n-pentyl (meth) acrylate, n-hexyl (meth)acrylate, n-heptyl (meth) acrylate, n-octyl (meth)acrylate, n-decyl (meth)acrylate, n-dodecyl (meth)acrylate, n-lauryl (meth)acrylate, n-tetradecyl (meth) acrylate, n-hexadecyl (meth)acrylate, n-octadecyl (meth) acrylate, isopropyl (meth)acrylate, isobutyl (meth)acrylate, tert-butyl (meth)acrylate, isopentyl (meth) acrylate, amyl (meth) acrylate, neopentyl (meth) acrylate, isohexyl (meth) acrylate, isoheptyl (meth)acrylate, isooctyl (meth)acrylate, 2-ethylhexyl (meth)acrylate, phenyl (meth)acrylate, biphenyl (meth)acrylate, diphenylethyl (meth)acrylate, tert-butylphenyl (meth)acrylate, terphenyl (meth) acrylate, cyclohexyl (meth) acrylate, t-butylcyclohexyl (meth)acrylate, dimethylaminoethyl (meth)acrylate, diethylaminoethyl (meth)acrylate, methoxyethyl (meth)acrylate, 2-hydroxyethyl (meth) acrylate, β-carboxyethyl (meth) acrylate, (meth)acrylonitrile, (meth)acrylamide.

When a carboxyl group is introduced into the styrenic resins, the (meth) acrylic resins and their copolymer resins as above, then the monomers for them may be copolymerized with a carboxyl group-having polymerizing monomer.

Specific examples of the polymerizing monomer of the type are acrylic acid, aconitic acid, atropic acid, allylmalonic acid, angelic acid, isocrotonic acid, itaconic acid, 10-undecenoic acid, elaidic acid, erucic acid, oleic acid, ortho-carboxycinnamic acid, crotonic acid, chloroacrylic acid, chloroisocrotonic acid, chlorocrotonic acid, chlorofumaric acid, chloromaleic acid, cinnamic acid, cyclohexenedicarboxylic acid, citraconic acid, hydroxycinnamic acid, dihydroxycinnamic acid, tiglic acid, nitrocinnamic acid, vinylacetic acid, phenylcinnamic acid, 4-phenyl-3-butenoic acid, ferulic acid, fumaric acid, brassidic acid, 2-(2-furyl) acrylic acid, bromocinnamic acid, bromofumaric acid, bromomaleic acid, benzylidenemalonic acid, benzoylacrylic acid, 4-pentenoic acid, maleic acid, mesaconic acid, methacrylic acid, methylcinnamic acid, methoxycinnamic acid. In view of the easiness in polymerization reaction with them, preferred re acrylic acid, methacrylic acid, maleic acid, cinnamic acid and fumaric acid.

In producing the binder resin for the toner of the invention through polymerization, a chain transfer agent may be used. Though not specifically defined, a thiol component-having compound may be used as the chain transfer agent. Concretely, preferred for use herein are alkylmercaptans such as hexylmercaptan, heptylmercaptan, octylmercaptan, nonylmercaptan, decylmercaptan, dodecylmercaptan. They are especially preferred since the binder resin produced may have a narrow molecular weight distribution and therefore the storability at high temperatures of the toner containing the binder resin of the type is good.

If desired, a crosslinking agent may be added to the binder resin for use in the invention.

Specific examples of the crosslinking agent are aromatic polyvinyl compounds such as divinylbenzene, divinylnaphthalene; polyvinyl esters of aromatic polycarboxylic acids such as divinyl phthalate, divinyl isophthalate, divinyl terephthalate, divinyl homophthalate, divinyl/trivinyl trimesate, divinyl naphthalenedicarboxylate, divinyl biphenylcarboxylate; divinyl esters of nitrogen-containing aromatic compounds such as divinyl pyridinedicarboxylate; vinyl esters of unsaturated heterocyclic compounds such as vinyl pyromucate, vinyl furancarboxylate, vinyl pyrrole-2-carboxylate, vinyl thiophenecarboxylate; (meth)acrylates of linear polyalcohols such as butanediol methacrylate, hexanediol acrylate, octanediol methacrylate, decanediol acrylate, dodecanediol acrylate; (meth) acrylates of branched substituted polyalcohols such as neopentyl glycol dimethacrylate, 2-hydroxy-1,3-diacryloxypropane; polyethylene glycol di(meth)acrylate, polypropylene-polyethylene glycol di (meth) acrylate; polyvinyl esters of polycarboxylic acids such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, divinyl dodecanedioate, divinyl brassylate.

One or more these crosslinking agents may be used in the invention either singly or as combined. Of the above-mentioned crosslinking agents, preferred for use in the invention are (meth)acrylates of linear polyalcohols such as butanediol methacrylate, hexanediolmethacrylate, octanediolmethacrylate, decanediol methacrylate, dodecanediol methacrylate; (meth)acrylates of branded substituted polyalcohols such as neopentylglycol dimethacrylate, 2-hydroxy-1,3-diacryloxypropane; polyethylene glycol di(meth)acrylate, polypropylene-polyethylene glycol di(meth)acrylate.

Preferably, the amount of the crosslinking agent that may be in the binder resin is from 0.05 to 5% by weight, more preferably from 0.1 to 1.0% by weight of the total weight of the polymerizing monomer.

Of the resins usable in the toner in the invention, those that are produced through radical polymerization of a polymerizing monomer may be produced in the presence of an initiator for radical polymerization.

The initiator for radical polymerization usable herein is not specifically defined. Concretely, it includes peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin-hydroperoxide, 1-phenyl-2-methylpropyl-1-hydroperoxide, pertriphenylacetic acid, tert-butylhydroperoxide, tert-butyl performate, tert-butyl peracetate, tert-butyl perbenzoate, tert-butyl perphenylacetate, tert-butyl permethoxyacetate, tert-butyl per-N-(3-toluyl)carbamate; azo compounds such as 2,2'-azobispropane, 2,2'-dichloro-2,2'-azobispropane, 1,1'-azo(methylethyl) diacetate, 2,2'-azobis(2-amidinopropane) hydrochloride, 2,2'-azobis (2-amidinopropane) nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(1-methylbutyronitrile-3-sodium sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,17-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1,1'-azobis-1,2-diphenylethane, poly(bisphenol A 4,4'-azobiscyanopentanoate), poly(tetraethylene glycol 2,2'-azobisisobutyrate); 1,4-bis(pentaethylene)-2-tetrazene, 1,4-dimethoxycarbonyl-1,4-diphenyl-2-tetrazene.

In producing the toner of the invention, for example, a surfactant may be added thereto for the purpose of stabilizing the dispersion in the above-mentioned suspension polymerization method, or for the purpose of stabilizing the resin particle dispersion, the colorant dispersion and the lubricant dispersion in the above-mentioned emulsion polymerization aggregation method.

The surfactant includes anionic surfactants such as sulfate ester salts, sulfonate salts, phosphate esters, soap; cationic surfactants such as amine salts, quaternary ammonium salts; nonionic surfactants such as polyethylene glycols, alkylphenol ethyleneoxide adducts, polyalcohols. Of those, preferred are ionic surfactants; and more preferred are anionic surfactants and cationic surfactants.

In the toner of the invention, in general, an anionic surfactant exhibits a strong dispersion power and is excellent in dispersing resin particles and colorant. In this, therefore, an anionic surfactant is advantageous as the surfactant for dispersing lubricant therein.

Preferably, a nonionic surfactant is combined with any of the above-mentioned anionic or cationic surfactant. One or more different types of the above-mentioned surfactants may be used herein either singly or as combined.

Specific examples of the anionic surfactant usable herein are fatty acid soaps such as potassium laurate, sodium oleate, sodium castor oil; sulfate esters such as octyl sulfate, lauryl sulfate, lauryl ether sulfate, nonylphenyl ether sulfate; lauryl sulfonate, dodecylbenzenesulfonate; sodium alkylnaphthalenesulfonates such as triisopropylnaphthalenesulfonate; dibutylnaphthalenesulfonate; sulfonate salts such as naphthalenesulfonate-formalin condensate, monooctyl sulfosuccinate, dioctyl sulfosuccinate, laurylamidesulfonate, oleylamidesulfonate, phosphate esters such as lauryl phosphate, isopropyl phosphate, nonylphenyl ether phosphate; dialkylsulfosuccinate salts such as sodium dioctylsulfosuccinate; sulfosuccinate salts such as disodium laurylsulfosuccinate.

Specific examples of the cationic surfactant usable herein are amine salts such as laurylamine hydrochloride, stearylamine hydrochloride, oleylamine acetate, stearylamine acetate, stearylaminopropylamine acetate; quaternary ammonium salts such as lauryltrimethylammonium chloride, dilauryldimethylammonium chloride, distearyldimethylammonium chloride, distearyldimethylammonium chloride, lauryldihydroxyethylmethylammonium chloride, oleylbispolyoxyethylenemethylammonium chloride, laauroylaminopropyldimethylethylammonium ethosulfate, lauroylaminopropyldimethylhydroxyethylammonium perchlorate, alkylbenzenetrimethylammonium chloride, alkyltrimethylammonium chloride.

Specific examples of the nonionic surfactant usable herein are alkyl ethers such as polyoxyethylene octyl ether, polyoxyethylene lauryl ether, polyoxyethylene stearyl ether, polyoxyethylene oleyl ether; alkylphenyl ethers such as polyoxyethylene octylphenyl ether, polyoxyethylenenonylphenyl ether; alkyl esters such as polyoxyethylene laurate, polyoxyethylene stearate, polyoxyethylene oleate; alkylamines such as polyoxyethylene laurylaminoether, polyoxyethylene stearylaminoether, polyoxyethylene oleylaminoether, polyoxyethylene soybean aminoether, polyoxyethylene beef tallow aminoether; alkylamides such as polyoxyethylene lauramide, polyoxyethylene stearamide, polyoxyethylene oleamide; vegetable oil ethers such as polyoxyethylene castor oil ether, polyoxyethylene rapeseed oil ether; alkanolamides such as laurodiethanolamide, stearodiethanolamide, oleodiethanolamide; sorbitan ester ethers such as polyoxyethylene sorbitanmonolaurate, polyoxyethylene sorbitan monopalmitate, polyoxyethylene sorbitan monostearate, polyoxyethylene sorbitan monooleate.

The content of the surfactant in each dispersion may be any one not detracting from the invention, but in general, it is small. Concretely, it may be from 0.01 to 3% by weight or so, more preferably from 0.05 to 2% by weight or so, even more preferably from 0.1 to 1% by weight or so. Falling within the range as above, the resin particle dispersion, the colorant dispersion and the lubricant dispersion are stable and therefore do not separately aggregate. In addition, when they together aggregate, there is no difference in the stability between them and no specific particles are freed. Further, the amount of the iron compound internally added to the toner does not decrease, and the toner sufficiently and favorably exhibits the effect of the invention. In general, the suspension-polymerized toner dispersion having a large particle size is stable even when the amount of the surfactant added is small.

A hardly water-soluble hydrophilic inorganic powder may be used as a dispersion stabilizer for the suspension polymerization mentioned above. The inorganic powder usable herein includes silica, alumina, titania, calcium carbonate, magnesium carbonate, tricalcium phosphate (hydroxyapatite), clay, diatomaceous earth, bentonite. Of those, preferred are calcium carbonate and tricalcium phosphate as they are easy to form, their particle size is easy to control and they are easy to remove.

In addition, an aqueous polymer solid at room temperature is also usable. Concretely, it includes cellulosic compounds such as carboxymethyl cellulose, hydroxypropyl cellulose; polyvinyl alcohol, gelatin, starch, arabic gum.

If desired, an antistatic agent may be added to the toner of the invention.

The antistatic agent may be any known one, including, for example, azo-type metal complex compounds, salicylic acid metal complex compounds, and polar group-having resin-type compounds. When the toner is produced according to a wet process, then a hardly water-soluble material is preferably used for ion strength (%) control and for prevention of waste water pollution. The toner of the invention may be either a magnetic toner that contains a magnetic material or a non-magnetic toner not containing a magnetic material.

When the toner of the invention is produced according to an emulsion polymerization aggregation method, the dispersed ingredients are aggregated into particles through pH change in the system in the aggregation step. If desired, an aggregation promoter may be added to the system for stabilizing the aggregated particles of for rapidly obtaining the aggregated particles or for making the aggregated particles have a narrower particle size distribution.

The aggregation promoter is preferably a mono- or more poly-valent compound. Specific examples of the compound are water-soluble surfactants such as the above-mentioned ionic surfactants and non ionic surfactants; acids such as hydrochloric acid, sulfuric acid, nitric acid, acetic acid, oxalic acid; metal salts of inorganic acids such as magnesium chloride, sodium chloride, aluminiumsulfate, calciumsulfate, ammoniumsulfate, aluminium nitrate, silver nitrate, copper sulfate, sodium carbonate; metal salts of aliphatic acids or aromatic acids such as sodium acetate, potassium formate, sodium oxalate, sodium phthalate, potassium salicylate; metal salts of phenols such as sodium phenolate; metal salts of amino acids; inorganic acid salts of aliphatic or aromatic amines such as triethanolamine hydrochloride, aniline hydrochloride.

In consideration of the stability of the aggregated particles, the stability of the aggregation promoter to heating or aging, and the easiness in removing the aggregation promoter, metal salts of inorganic acids are preferred for the aggregation promoter in view of their capability and handlability. Concretely, preferred are metal salts of inorganic acids such as magnesium chloride, sodium chloride, aluminium sulfate, calcium sulfate, ammonium sulfate, aluminium nitrate, silver nitrate, copper sulfate, sodium carbonate.

The amount of the aggregation promoter to be added varies, depending on the number of charge valences thereof. Anyhow, the amount may be small. Concretely, the amount of a monovalent compound may be at most 3% by weight or so; that of a divalent compound may be at most 1% by weight or so; and that of a trivalent compound may be at most 0.5% by weight or so. Since the amount of the aggregation promote is preferably smaller, a higher polyvalent compound is preferably used herein.

<Toner Colorant>

The colorant for use in the invention is not specifically defined. Any known colorant may be used herein, suitably selected in accordance with the object of the toner. One or more different types of colorants of a same color series may be used herein either singly or as combined. Two or more colorants of different color series may also be combined for use herein. The colorants may be subjected to surface treatment.

Specific examples of the colorants usable herein are black, blue, yellow, orange, red, violet, green and white colorants such as those mentioned below.

Black pigments may be organic or inorganic colorants such as carbon black, aniline black, activated charcoal, nonmagnetic ferrite, magnetite;

Blue pigments may be organic or inorganic colorants such as prussian blue, cobalt blue, alkali blue lake, victoria blue lake fast sky blue, indanthrene blue BC, ultramarine blue, phthalocyanine blue, phthalocyanine green;

Yellow pigments may be organic or inorganic colorants such as chrome yellow, zinc yellow, yellow iron oxide, cadmium yellow, chrome yellow, fast yellow, fast yellow 5G, fast yellow 5GX, fast yellow 10G, benzidine yellow G, benzidine yellow GR, threne yellow quinoline yellow, permanent yellow NCG;

Orange pigments may be organic or inorganic colorants such as red chrome yellow, molybdenum orange, permanent orange GTR, pyrazolone orange, Vulcan orange, benzidine orange G, indanthrene brilliant orange RK, indanthrene brilliant orange GK;

Red pigments may be organic or inorganic colorants such as red iron oxide, cadmium red, red lead, mercury sulfide, watch young red, permanent red 4R, Lithol red, brilliant carmine 3B, brilliant carmine 6B, Dupont oil red, pyrazolone red, rhodamine B lake, lake red C, rose bengal, eosine red, alizarin lake;

Violet pigments may be organic or inorganic colorants such as manganese violet, fast violet B, methyl violet lake;

Green pigments may be organic or inorganic colorants such as chromium oxide, chrome green, pigment green B, malachite green lake, Fanal yellow green G;

white pigments may include zinc flower, titanium oxide, antimony white, zinc sulfide;

Body pigments may include barite powder, barium carbonate, clay, silica, white carbon, talc, alumina white.

<Method for Dispersion of Colorant>

In the toner of the invention, the colorant may be dispersed in the binder resin in any known method. When the toner is produced according to a kneading and grinding method, then the colorant may be added thereto directly as it is, or may be added thereto according to a master batch process where the colorant is kneaded with a binder resin in producing the toner, or may be added according to a flashing method where the colorant is dispersed in the toner in the form of a wet cake thereof before it is dried after produced.

The colorant may be used directly as it is in producing the toner according to a suspension polymerization method. In the suspension polymerization method, the colorant dispersed in resin may be dissolved or dispersed in a polymerizing monomer, whereby the colorant may be dispersed in the granulated particles of the toner.

When the toner is produced according to the emulsion polymerization aggregation method as above, the colorant may be dispersed in an aqueous medium along with a dispersant such as surfactant by applying a mechanical shock thereto to thereby prepare a colorant dispersion, and this may be aggregated along with resin particles into particles having a toner particle size.

One example of dispersing the colorant by applying a mechanical shock thereto includes using any of media-assisted dispersers or high-pressure cascade collision dispersers such as rotary shear homogenizer, ball mill, sand mill and attritor to prepare a dispersion of colorant particles. The colorant may be dispersed in an aqueous system along with a polar surfactant by the use of a homogenizer.

Preferably, the amount of the colorant that may be in the toner is from 4% by weight to 15% by weight relative to the total weight of the solid content of the toner, more preferably from 4% by weight to 10% by weight. However, when an iron-free magnetic substance is used as a black colorant, then its amount is preferably from 12% by weight to 48% by weight, more preferably from 15% by weight to 40% by weight. The above-mentioned colorants are suitably selected, and various toners such as yellow toner, magenta toner, cyan toner, black toner, white toner and green toner can be obtained.

<Lubricant>

If desired, a lubricant may be added to the toner of the invention. The lubricant is generally used for the purpose of improving the releasability of the toner. Specific examples of the lubricant are low-molecular-weight polyolefins such as polyethylene, polypropylene, polybutene; silicones having a softening point under heat; fatty acid amides such as oleamide, erucamide, ricinoleamide, stearamide; vegetable waxes such as carnauba wax, rice wax, candelilla wax, haze wax, jojoba wax; animal waxes such as bees wax; mineral petroleum waxes such as montan wax, ozokerite wax, ceresine, paraffin wax, microcrystalline wax, Fisher-Tropsch wax; ester waxes such as fatty acid esters, montanates, carboxylates. One or more these lubricants may be used in the invention either singly or as combined.

The amount of the lubricant in the toner is preferably from 1 to 20% by weight relative to the total amount of the toner particles, more preferably from 5 to 15% by weight. Falling within the range, the lubricant well exhibits its effect. As a result, an iron compound may be uniformly dispersed in the toner, the toner particles are hardly broken in developing machines and therefore the lubricant does not move to the carrier in the toner, and the charge level of the charged toner hardly lowers.

<Internal Additives>

The toner of the invention may contain internal additives. In general, internal additives are used for the purpose of controlling the viscoelasticity of fixed images. Specific examples of the internal additives are inorganic particles such as silica, titania; and organic particles such as polymethyl methacrylate. These may be subjected to surface treatment for the purpose of increasing their dispersibility. One or more such internal additives may be used herein either herein or as combined.

<External Additives>

External additives such as fluidizer and antistatic agent may be added to the toner of the invention. Any known material may be used as the external additives, including, for example, inorganic particles such as silica, titanium oxide, alumina, cerium oxide and carbon black that are processed with a silane coupling agent on their surface; polymer particles such as polycarbonate, polymethyl methacrylate, silicone resin; amine metal salts, salicylic acid metal complexes. One or more such external additives may be used herein either singly or as combined.

<Carrier>

The toner of the invention may be used in any form of a one-component developer that has the ability of charging it in developing machines, or a two-component developer that contains toner and carrier. The carrier for the toner of the invention is preferably a cored carrier in which the core of ferrite or iron powder is coated with resin. The core (carrier core) is not specifically defined, including, for example, magnetic metals such as iron, copper, nickel, cobalt; magnetic oxides such as ferrite, magnetite; glass beads. When the toner is used in a magnetic brush process, the carrier is preferably a magnetic carrier. The mean particle size of the carrier core is preferably from 3 times to 10 times as large as the mean particle size of the toner particles.

For the coating resin, usable are acrylic resins, styrene resins, amino resins including urea, urethane, melamine, guanamine, aniline; and amide resins and urethane resins. Their copolymer resins are also usable. Two or more these resins may be combined for the carrier-coating resin. Resin particles or inorganic particles may be dispersed in the coating resin for the purpose of controlling the charge of the carrier.

For forming the resin-coating layer on the surface of the carrier core, for example, usable are a dipping method comprising dipping a carrier core powder in a coating layer-forming solution; a spraying method comprising spraying a coating layer-forming solution on a carrier core; a fluidized bed method comprising spraying a coating layer-forming solution on a carrier core flowing in fluidized air; a kneader coater method comprising mixing a carrier core and a coating layer-forming solution in a kneader coater and removing the solvent; and a powder coating method comprising powdering a coating resin, then mixing the resulting resin powder and a carrier core in a kneader coater at a temperature not lower than the melting point of the coating resin, and cooling the resulting mixture so as to coat the carrier core with the resin. Of those, especially preferred are a kneader coater method and a powder coating method.

The amount of the resin that coats the carrier core according to the methods as above may be from 0.5 to 10% by weight of the carrier core. The mixing ratio (by weight) of the toner to the carrier, toner/carrier may be from 1/100 to 30/100 or so, more preferably from 3/100 to 20/100 or so.

<Image Formation Method>

The method for image formation of the invention includes a step of charging a photoreceptor (electrostatic latent image carrier), a step of exposing the charged photoreceptor to light to thereby form a latent image on the photoreceptor, a step of developing the latent image with a developer to form a developed image, a step of transferring the developed image onto a transfer object, and a step of heating and fixing the developed image on a fixation substrate; wherein the developer is any of the toner for electrostatic latent image development or the electrostatic latent image developer of the invention.

The steps of the method are per-se known steps, for example, as described in JP-A56-40868 and 49-91231. The method for image formation of the invention may be carried out in any known image-forming devices such as ordinary copying machines and facsimiles.

The charging mode is not specifically defined, and may be in any mode of known corotron or scorotron non-contact electrification or contact electrification. Preferred is the latter contact electrification system that releases a smaller amount of ozone.

An electrostatic latent image is formed in the exposure step where an electrostatic latent image carrier uniformly charged on the surface thereof is exposed to light by the use of an exposure unit such as a laser optical system or an LED array to thereby form an electrostatic latent image on the carrier. The exposure system for it is not specifically defined.

In the transfer step, the toner image formed is transferred onto a transfer object. Examples of the transfer object are transfer paper, and intermediate drum and intermediate transfer belt used in color image formation.

In the fixation step, the toner image transferred on transfer paper or the like is fixed on a fixation substrate such as copy paper by heating it with fixation members. Briefly, a fixation substrate such as copying paper is passed through two fixation members, and the toner is thereby heated, fused and fixed on the fixation substrate. The fixation members are rolls or belts, at least one side of which is equipped with a heating unit. Rolls or belts may be used as the fixation members, either directly as they are or after coated with resin.

The fixation roll may be formed by coating the surface of a roll core with silicone rubber or viton rubber.

The fixation belt may be formed of polyamide, polyimide, polyethylene terephthalate or polybutylene terephthalate either singly or as combined. The coating resin for the roll and the belt includes, for example, homopolymers of styrenes such as styrene, parachlorostyrene, α-methylstyrene; α-methylene-monocarboxylates such as methyl acrylate, ethyl acrylate, n-propyl acrylate, lauryl acrylate, 2-ethylhexyl acrylate, methyl methacrylate, n-propyl methacrylate, lauryl methacrylate, 2-ethylhexyl methacrylate; nitrogen-containing acrylates such as dimethylaminoethyl methacrylate; vinylnitriles such as acrylonitrile, methacrylonitrile; vinylpyridines such as 2-vinylpyridine, 4-vinylpyridine; vinyl ethers such as vinyl methyl ether, vinyl isobutyl ether; vinyl ketones such as vinyl methyl ketone, vinyl ethyl ketone, vinyl isopropenyl ketone; olefins such as ethylene, propylene; vinyl-type fluorine-containing monomers such as vinylidene fluoride, tetrafluoroethylene, hexafluoroethylene; copolymers of two or more different types of the monomers mentioned above; silicones such as methylsilicone, methylphenylsilicone; bisphenol or glycol-containing polyesters; epoxy resins, polyurethane resins, polyamide resins, cellulose resins, polyether resins, polycarbonate resins. One or more such resins may be used herein either singly or as combined. Concretely, herein usable are homopolymers and/or copolymers of fluorine-containing compounds such as polytetrafluoroethylene, vinylidene fluoride, ethylene fluoride; and homopolymers and/or copolymers of unsaturated hydrocarbons such as ethylene, propylene.

Paper and resin films may be used for the transfer object on which toner images are fixed. Coated paper prepared by partially or entirely coating the surface of paper with resin may be used for fixation paper. Resin-coated films prepared by partially or entirely coating the surface of a resin film with a different type of resin may also be used for fixation resin films. If desired, resin particles or inorganic particles may be added to the coating resin for transfer paper and resin films for the purpose of preventing erroneous multi-feeding of two or more transfer sheets in one transfer operation owing to friction and/or friction-caused static electricity of the transfer sheets and for the purpose of preventing the lubricant from being released in the interface between the transfer object and the fixed image during fixation to worsen the adhesion of the fixed image.

Specific examples of the coating resin for paper and resin films are homopolymers of styrenes such as styrene, parachlorostyrene, α-methylstyrene; α-methylene-monocarboxylates such as methyl acrylate, ethyl acrylate, n-propyl acrylate, lauryl acrylate, 2-ethylhexyl acrylate, methyl methacrylate, n-propyl methacrylate, lauryl methacrylate, 2-ethylhexyl methacrylate; nitrogen-containing acrylates such as dimethylaminoethyl methacrylate; vinylnitriles such as acrylonitrile, methacrylonitrile; vinylpyridines such as 2-vinylpyridine, 4-vinylpyridine; vinyl ethers such as vinyl methyl ether, vinyl isobutyl ether; vinyl ketones such as vinyl methyl ketone, vinyl ethyl ketone, vinyl isopropenyl ketone; olefins such as ethylene, propylene; vinyl-type fluorine-containing monomers such as vinylidene fluoride, tetrafluoroethylene, hexafluoroethylene; copolymers of two or more different types of the monomers mentioned above; silicones such as methylsilicone, methylphenylsilicone; bisphenol or glycol-containing polyesters; epoxy resins, polyurethane resins, polyamide resins, cellulose resins, polyether resins, polycarbonate resins. One or more such resins may be used herein either singly or as combined.

Specific examples of the inorganic particles are silica, titania, calcium carbonate, magnesium carbonate, tricalcium phosphate, cerium oxide. All types of inorganic particles generally used as external additives to toner may be used for them. The resin particles are, for example, vinylic resins, polyester resins, silicone resins; and all types of resin particles generally used as external additives to toner may be used for them. These inorganic particles and resin particles may be used herein also as a fluidity promoter for toner.

EXAMPLES

The invention is described in detail with reference to the following Examples, to which, however, the invention should not be limited. Unless otherwise specifically indicated in the following description, "part" is by weight.

<Method for Determination of Particle Size and Particle Size Distribution>

Determination of particle size and particle size distribution in the invention is described. When the particles to be analyzed in the invention are 2 μm or more in size, then an analyzer, Coulter Counter TA-II Model (by Beckman-Coulter) is used in which the electrolyte is ISOTON-II (by Beckman-Coulter).

The method is described. From 0.5 to 50 mg of a sample to be analyzed is added to 2 ml of an aqueous 5% solution of a surfactant, preferably sodium alkylbenzenesulfonate serving as a dispersant. This is added to 100 ml of the electrolyte.

The electrolyte with the sample suspended therein is dispersed in an ultrasonic disperser for about 1 minute, and then analyzed with the analyzer, Coulter Counter TA-II Model. The aperture diameter is 100 μm, and the particles of from 2 to 60 μm in size are analyzed for their particle size distribution, the volume-average distribution and the number-average distribution. The number of the particles to be analyzed is 50,000.

The particle size distribution of the toner of the invention is analyzed as follows: The data of the particle size distribution determined are plotted relative to the divided particle size ranges (channels) to draw the volume cumulative distribution curve starting from the particles having a smaller particle size. In this, the particle size of 16% number cumulative particles is defined as D16p; and the particle size of 50% volume cumulative particles is defined as D50v. The particle size of 84% number cumulative particles is defined as D84p.

In the invention, D50v indicates the volume-average particle size of the toner particles; and GSDp is calculated according to the following formula:

$$GSDp=\{(D84p)/(D16p)\}^{0.5}$$

When the particles to be analyzed in the invention are smaller than 2 μm in size, then a laser diffraction particle sizer, LA-700 (by Horiba Seisakusho) is used. The method is described. About 2 g, in terms of the solid content thereof, of a dispersion of a sample to be analyzed is prepared, to which ion-exchanged water is added to make it about 40 ml in total. This is put into a cell to have a suitable concentration therein, and, after about 2 minutes, this is analyzed when the concentration in the same has become almost stable. The volume-average particle size of every channel thus determined is accumulated from the particles having a smaller volume-average particle size, and the particle size of 50% volume cumulative particles is read. This is the volume-average particle size of the sample.

Powdery external additives are analyzed as follows: 2 g of a sample to be analyzed is put into an aqueous 5% solution of a surfactant, preferably sodium alkylbenzenesulfonate. This is dispersed with an ultrasonic disperser (1,000 Hz) for 2 minutes, and the resulting dispersion is analyzed in the same manner as that for the above-mentioned dispersion.

<Method for Determination of Sphericity Factor of Toner>

The sphericity factor SF1 of toner is determined as follows: A toner sample to be analyzed is put on a glass slide, and its optical microscopic image is taken into a Luzex image analyzer via a video camera. 50 particles on the image are analyzed. From $((ML)^2/A)$ where ML indicates the maximum length of the toner particle and A indicates the projected area of the toner particle, SF1 is calculated according to the following formula, and the data are averaged.

$$SF1=(ML)^2/A\times\pi/4\times100$$

<Method of X-ray Fluorescence Analysis>

Sample pretreatment is as follows: 6 g of a toner to be analyzed is molded in a compression molding machine under 10 tons for 1 minute. Then, this is analyzed with an X-ray fluorescence analyzer, Shimadzu's XRF-1500. The tube voltage is 40 kV, the tube current is 90 mA and the test time is 30 minutes.

<Preparation of Resin Particle Dispersion (1)>

| | |
|---|---|
| Styrene | 296 pts. |
| n-butyl acrylate | 104 pts. |
| Acrylic acid | 6 pts. |
| Dodecanediol | 10 pts. |
| Divinyl adipate | 1.6 pts. |

(These chemicals are from Wako Pure Chemicals).

The above ingredients were mixed and dissolved. The resulting solution was added to a solution prepared by dissolving 12 parts of a nonionic surfactant (Sanyo Chemical's Nonipol 400) and 8 parts of an anionic surfactant (Daiichi Kogyo Seiyaku's Neogen SC) in 550 parts of ion-exchanged water in a flask, and dispersed and emulsified. While this was gradually stirred for 10 minutes, 50 parts of ion-exchanged water with 8 parts of ammonium persulfate (by Wako Pure Chemicals) dissolved therein was added to it, and purged with nitrogen at a rate of 0.1 liter/min for 20 minutes. Next, the contents of the flask were stirred and heated in an oil bath up to 70° C. Then, the emulsion polymerization of the system was continued as it was for 5 hours, and a resin particle dispersion (1) having a volume-average particle size of 200 nm and a solid concentration of 41% was thus prepared. A part of the dispersion was put on an oven at 100° C. and water was removed from it. This was subjected to DSC (differential scanning calorimetry). Its glass transition point was 53° C. and its weight-average molecular weight was 30,000.

<Preparation of Colorant Dispersion (1)>

| | |
|---|---|
| C.I. Pigment Yellow 74 (monoazo pigment) (Dainichi Seika's Seika Fast Yellow 2054) | 100 pts |
| Anionic surfactant (Daiichi Kogyo Seiyaku's Neogen SC) | 10 pts. |
| Ion-exchanged water | 490 pts. |

The above ingredients were mixed and dissolved, and dispersed for 10 minutes by the use of a homogenizer (IKA's Ultratalax) to prepare a colorant dispersion (1).

<Preparation of Colorant Dispersion (2)>

A colorant dispersion (2) was prepared in the same manner as that for the colorant dispersion (1), for which, however, C.I. Pigment Red 122 (quinacridone pigment, Dainichi Seika's Chromo Fine Magenta 6887) was used as the colorant.

<Preparation of Colorant Dispersion (3)>

A colorant dispersion (3) was prepared in the same manner as that for the colorant dispersion (1), for which, however, C.I. Pigment Blue 15:3 (phthalocyanine pigment, Dainichi Seika's Cyanine Blue 4937) was used as the colorant.

<Preparation of Colorant Dispersion (4)>

A colorant dispersion (4) was prepared in the same manner as that for the colorant dispersion (1), for which, however, carbon black (Cabot's R330) was used as the colorant.

<Preparation of Lubricant Particle Dispersion (1)>

| | |
|---|---|
| Paraffin wax (Nippon Seiro's HNP-9 | 100 pts. |
| Anionic surfactant (Lion's Lipal 860 K) | 10 pts. |
| Ion-exchanged water | 390 pts. |

The above ingredients were mixed and dissolved, then dispersed by the use of a homogenizer (IKA's Ultratalax), and further dispersed by the use of a pressure-jet homogenizer to prepare a lubricant particle dispersion (1) with lubricant particles (paraffin fax) dispersed therein.

<Preparation of Aqueous Divalent Iron Ion Solution (1)>

5 parts of iron(II) chloride (by Wako Pure Chemicals) was added to 100 parts of ion-exchanged water to prepare an aqueous divalent iron ion solution (1).

<Production of Yellow Toner (1)>

| | |
|---|---|
| Resin particle dispersion (1) | 320 pts. |
| Colorant dispersion (1) | 80 pts. |
| Lubricant particle dispersion (1) | 100 pts. |
| Aqueous divalent iron ion solution (1) | 2.0 pts. |
| Aluminium sulfate (by Wako Pure Chemicals) | 1.5 pts. |
| Ion-exchanged water | 800 pts. |

The above ingredients were put into a stainless round-bottomed flask equipped with a jacket for temperature control, and dispersed by the use of a homogenizer (IKA's Ultratalax T50) at 5,000 rpm for 5 minutes. Then, this was transferred into a flask, and left stirred with 4 paddles at 25° C. for 20 minutes. Next, with further stirring, this was heated with a mantle heater at a heating rate of 1° C./min up to 48° C., and then kept at 48° C. for 20 minutes. Next, 80 parts of the resin particle dispersion was gradually added to it, then kept at 48° C. for 30 minutes, and an aqueous solution of 1 N sodium hydroxide was added to it to thereby make it have a pH of 6.5.

Next, this was heated at a heating rate of 1° C./min up to 95° C., and kept as such for 30 minutes. An aqueous solution of 0.1 N nitric acid was added to it so as to make it have a pH of 4.8. Then, this was kept at 95° C. for 2 hours. Next, an aqueous solution of 1 N sodium hydroxide was added to it to thereby make it have a pH of 6.5, and then kept at 95° C. for 5 hours. Then, this was cooled to 30° C. at 5° C./min.

Thus prepared, the toner particle dispersion was filtered, then (A) 2,000 parts of ion-exchanged water at 35° C. was added to the resulting toner particles; (B) this was kept stirred for 20 minutes; (C) and then this was filtered. The process of (A) to (C) was repeated 5 times, and then the toner particles on the filter paper was transferred into a vacuum drier, in which the particles were dried at 45° C. under 1,000 Pa or less for 10 hours. The reason why the toner particles were dried under 1,000 Pa or less is because, since the toner particles were in wet, water in them would freeze even at 45° C. in the initial stage of drying the particles and thereafter water would sublimate, and therefore the internal pressure inside the drier during the degassing stage could not be constant. However, at the end of drying, the pressure was stabilized at 100 Pa. After the drier was restored to atmospheric pressure, the toner particles were taken out of it. 1.0 part of an external additive, silica (Nippon Aerosil's R972) was added to 100 parts of the toner particles, and mixed by the use of a Henschel mixer at 3,000 rpm for 5 minutes to obtain an yellow toner (1).

Thus obtained, the yellow toner (1) has D50v of 5.8 μm, GSDp of 1.20, a sphericity factor SF1 of 130, and [Fe]/[C] of 0.00013.

<Production of Magenta Toner (1)>

A magenta toner (1) was produced in the same manner as that for the yellow toner (1), for which, however, the colorant dispersion (2) was used in place of the colorant dispersion (1)

Thus obtained, the magenta toner (1) has D50v of 5.5 μm, GSDp of 1.19, a sphericity factor SF1 of 137, and [Fe]/[C] of 0.00012.

<Production of Cyan Toner (1)>

A cyan toner (1) was produced in the same manner as that for the yellow toner (1), for which, however, the colorant dispersion (3) was used in place of the colorant dispersion (1).

Thus obtained, the cyan toner (1) has D50v of 5.7 μm, GSDp of 1.19, a sphericity factor SF1 of 135, and [Fe]/[C] of 0.00013.

<Production of Black Toner (1)>

A black toner (1) was produced in the same manner as that for the yellow toner (1), for which, however, the colorant dispersion (4) was used in place of the colorant dispersion (1).

Thus obtained, the black toner (1) has D50v of 6.0 μm, GSDp of 1.22, a sphericity factor SF1 of 132, and [Fe]/[C] of 0.00014.

<Production of Yellow Toner (2)>

An yellow toner (2) was produced in the same manner as that for the yellow toner (1), to which, however, 1.0 part of the aqueous divalent iron ion solution (1) was added.

Thus obtained, the yellow toner (2) has D50v of 6.0 μm, GSDp of 1.19, a sphericity factor SF1 of 133, and [Fe]/[C] of 0.00006.

<Production of Magenta Toner (2)>

A magenta toner (2) was produced in the same manner as that for the yellow toner (2), for which, however, the colorant dispersion (2) was used in place of the colorant dispersion (1).

Thus obtained, the magenta toner (2) has D50v of 5.7 μm, GSDp of 1.20, a sphericity factor SF1 of 140, and [Fe]/[C] of 0.00007.

<Production of Cyan Toner (2)>

A cyan toner (2) was produced in the same manner as that for the yellow toner (2), for which, however, the colorant dispersion (3) was used in place of the colorant dispersion (1).

Thus obtained, the cyan toner (2) has D50v of 5.9 μm, GSDp of 1.16, a sphericity factor SF1 of 133, and [Fe]/[C] of 0.00008.

<Production of Black Toner (2)>

A black toner (2) was produced in the same manner as that for the yellow toner (2), for which, however, the colorant dispersion (4) was used in place of the colorant dispersion (1).

Thus obtained, the black toner (2) has D50v of 5.2 μm, GSDp of 1.21, a sphericity factor SF1 of 133, and [Fe]/[C] of 0.00010.

<Production of Yellow Toner (3)>

An yellow toner (3) was produced in the same manner as that for the yellow toner (1), to which, however, 3.0 parts of the aqueous divalent iron ion solution (1) was added.

Thus obtained, the yellow toner (3) has D50v of 5.5 μm, GSDp of 1.21, a sphericity factor SF1 of 136, and [Fe]/[C] of 0.00019.

<Production of Magenta Toner (3)>

A magenta toner (3) was produced in the same manner as that for the yellow toner (3), for which, however, the colorant dispersion (2) was used in place of the colorant dispersion (1).

Thus obtained, the magenta toner (3) has D50v of 5.2 μm, GSDp of 1.20, a sphericity factor SF1 of 132, and [Fe]/[C] of 0.00018.

<Production of Cyan Toner (3)>

A cyan toner (3) was produced in the same manner as that for the yellow toner (3), for which, however, the colorant dispersion (3) was used in place of the colorant dispersion (1).

Thus obtained, the cyan toner (3) has D50v of 5.4 μm, GSDp of 1.20, a sphericity factor SF1 of 140, and [Fe]/[C] of 0.00020.

<Production of Black Toner (3)>

A black toner (3) was produced in the same manner as that for the yellow toner (3), for which, however, the colorant dispersion (4) was used in place of the colorant dispersion (1).

Thus obtained, the black toner (3) has D50v of 5.7 μm, GSDp of 1.20, a sphericity factor SF1 of 137, and [Fe]/[C] of 0.00017.

<Production of Yellow Toner (4)>

An yellow toner (4) was produced in the same manner as that for the yellow toner (1), to which, however, 0.3 parts of the aqueous divalent iron ion solution (1) was added.

Thus obtained, the yellow toner (4) has D50v of 6.0 μm, GSDp of 1.20, a sphericity factor SF1 of 132, and [Fe]/[C] of 0.00001.

<Production of Magenta Toner (4)>

A magenta toner (4) was produced in the same manner as that for the yellow toner (4), for which, however, the colorant dispersion (2) was used in place of the colorant dispersion (1).

Thus obtained, the magenta toner (4) has D50v of 5.7 μm, GSDp of 1.19, a sphericity factor SF1 of 139, and [Fe]/[C] of 0.00002.

<Production of Cyan Toner (4)>

A cyan toner (4) was produced in the same manner as that for the yellow toner (4), for which, however, the colorant dispersion (3) was used in place of the colorant dispersion (1).

Thus obtained, the cyan toner (4) has D50v of 5.9 μm, GSDp of 1.19, a sphericity factor SF1 of 130, and [Fe]/[C] of 0.00003.

<Production of Black Toner (4)>

A black toner (4) was produced in the same manner as that for the yellow toner (4), for which, however, the colorant dispersion (4) was used in place of the colorant dispersion (1).

Thus obtained, the black toner (4) has D50v of 5.5 μm, GSDp of 1.19, a sphericity factor SF1 of 131, and [Fe]/[C] of 0.00004.

<Production of Yellow Toner (5)>

An yellow toner (5) was produced in the same manner as that for the yellow toner (1), to which, however, 5.0 parts of the aqueous divalent iron ion solution (1) was added.

Thus obtained, the yellow toner (5) has D50v of 5.4 μm, GSDp of 1.19, a sphericity factor SF1 of 135, and [Fe]/[C] of 0.00030.

<Production of Magenta Toner (5)>

A magenta toner (5) was produced in the same manner as that for the yellow toner (5), for which, however, the colorant dispersion (2) was used in place of the colorant dispersion (1).

Thus obtained, the magenta toner (5) has D50v of 5.1 μm, GSDp of 1.22, a sphericity factor SF1 of 133, and [Fe]/[C] of 0.00031.

<Production of Cyan Toner (5)>

A cyan toner (5) was produced in the same manner as that for the yellow toner (5), for which, however, the colorant dispersion (3) was used in place of the colorant dispersion (1).

Thus obtained, the cyan toner (5) has D50v of 5.3 μm, GSDp of 1.22, a sphericity factor SF1 of 133, and [Fe]/[C] of 0.00035.

<Production of Black Toner (5)>

A black toner (5) was produced in the same manner as that for the yellow toner (5), for which, however, the colorant dispersion (4) was used in place of the colorant dispersion (1).

Thus obtained, the black toner (5) has D50v of 5.6 μm, GSDp of 1.22, a sphericity factor SF1 of 133, and [Fe]/[C] of 0.00040.

<Production of Yellow Toner (6)>

101 parts of isophthalic acid, 180 parts of bisphenol A/propylene oxide (2 mol) adduct, and 5.4 parts of dibutyltin oxide were put into a flask, and reacted for dehydrating condensation in a nitrogen atmosphere at 230° C. The reaction was continued for 16 hours. The polyester resin thus obtained had an acid value of 42 mg KOH/g. Its weight-average molecular weight was 4,800.

174 parts of the polyester resin, 16 parts of C.I. Pigment Yellow 74 (Dainichi Seika's Seika Fast Yellow 2054), 10 parts of paraffin wax (Nippon Seiro's HNP-9) and 0.5 parts of the aqueous divalent iron ion solution (1) were put into a Banbury mixer (from Kobe Steel), and kneaded therein under pressure to make the inner temperature 110±5° C., at 80 rpm for 10 minutes. The thus-kneaded mixture was cooled, roughly ground in a hammer mill, and then powdered in a jet mill into particles of about 6.8 μm in size. The particles were classified in an elbow jet classifier (from Matsuzaka Trading), external additives were added to it in the same manner as that for the yellow toner (1), and yellow toner particles were thus obtained.

The yellow toner (6) thus obtained herein has D50v of 6.5 μm, GSDp of 1.23, a sphericity factor SF1 of 145, and [Fe]/[C] of 0.00014.

<Production of Magenta Toner (6)>

A magenta toner (6) was produced in the same manner as that for the yellow toner (6), for which, however, the colorant dispersion (2) was used in place of the colorant dispersion (1).

Thus obtained, the magenta toner (6) has D50v of 7.0 μm, GSDp of 1.24, a sphericity factor SF1 of 152, and [Fe]/[C] of 0.00014.

<Production of Cyan Toner (6)>

A cyan toner (6) was produced in the same manner as that for the yellow toner (6), for which, however, the colorant dispersion (3) was used in place of the colorant dispersion (1).

Thus obtained, the cyan toner (6) has D50v of 7.3 μm, GSDp of 1.24, a sphericity factor SF1 of 145, and [Fe]/[C] of 0.00015.

<Production of Black Toner (6)>

A black toner (6) was produced in the same manner as that for the yellow toner (6), for which, however, the colorant dispersion (4) was used in place of the colorant dispersion (1).

Thus obtained, the black toner (6) has D50v of 7.4 μm, GSDp of 1.25, a sphericity factor SF1 of 155, and [Fe]/[C] of 0.00014.

<Production of Yellow Toner (7)>

50 parts of terephthalic acid, 30 parts of dodecenylsuccinic acid, 18 parts of trimellitic anhydride, 85 parts of bisphenol A, 90 parts of bisphenol A/ethylene oxide (2 mol) adduct, and 5.4 parts of dibutyltin oxide were put into a flask, and reacted for dehydrating condensation in a nitrogen atmosphere at 230° C. The reaction was continued for 16 hours. The polyester resin thus obtained had an acid value of 2 mg KOH/g. The weight-average molecular weight of the tetrahydrofuran (THF)-soluble component of the resin was 5,000.

Using the polyester resin, an yellow toner was obtained in the same manner as that for the yellow toner (6).

Thus obtained, the yellow toner (7) has D50v of 7.0 μm, GSDp of 1.24, a sphericity factor SF1 of 147, and [Fe]/[C] of 0.00015.

<Production of Magenta Toner (7)>

A magenta toner (7) was produced in the same manner as that for the yellow toner (7), for which, however, the colorant dispersion (2) was used in place of the colorant dispersion (1).

Thus obtained, the magenta toner (7) has D50v of 7.2 μm, GSDp of 1.25, a sphericity factor SF1 of 154, and [Fe]/[C] of 0.00015.

<Production of Cyan Toner (7)>

A cyan toner (7) was produced in the same manner as that for the yellow toner (7), for which, however, the colorant dispersion (3) was used in place of the colorant dispersion (1).

Thus obtained, the cyan toner (7) has D50v of 6.9 μm, GSDp of 1.24, a sphericity factor SF1 of 154, and [Fe]/[C] of 0.00012.

<Production of Black Toner (7)>

A black toner (7) was produced in the same manner as that for the yellow toner (7), for which, however, the colorant dispersion (4) was used in place of the colorant dispersion (1).

Thus obtained, the black toner (7) has D50v of 7.2 μm, GSDp of 1.26, a sphericity factor SF1 of 149, and [Fe]/[C] of 0.00013.

<Production of Yellow Toner (8)>

32 parts of C.I. Pigment Yellow 74 (Dainichi Seika's Seika Fast Yellow 2054) and 40 parts of paraffin wax (Nippon Seiro's HNP-9) were added to 28 parts of the same polyester resin as that used in the yellow toner (6), and melted and kneaded in a pressure kneader to prepare a resin mixture.

| | |
|---|---|
| Styrene | 111 pts. |
| n-butyl acrylate | 32 pts. |
| 2-Ethylhexyl acrylate | 7 pts. |
| Tert-laurylmercaptan | 1.6 pts. |
| 2,2'-Azobis-2-methylvaleronitrile | 0.7 pts. |
| (These are all by Wako Pure Chemicals.) | |
| Resin mixture | 50.0 pts. |
| Aqueous divalent iron ion solution (1) | 1.0 pt. |

The above ingredients were stirred and melted, and added to an aqueous medium prepared by dispersing 10 parts of calcium carbonate in 300 parts of ion-exchanged water, and dispersed in a homogenizer (IKA's Ultratalax T50). The presence of oil drops having a mean particle size of 8.2 μm inside the dispersion was confirmed. The dispersion was heated up to 80° C. with nitrogen introduced thereinto, and left as such for 5 hours to obtain suspended polymer particles. After cooled, 1 N hydrochloric acid (by Wako Pure Chemicals) was dropwise added to it so as to make it have a pH of 2.2, and this was then left as such for 1 hour.

Next, the pH of the contents of the container was controlled to be about 7, and the reaction product was taken out through filtration and washed four times with 500 parts of ion-exchanged water. Then, this was transferred into a vacuum drier and dried therein at 45° C. under 1,000 Pa or lower for 10 hours. After thus dried, the same external additives as those for the yellow toner (1) were added to it to obtain an yellow toner. The pressure was 1,000 Pa or lower, and this is the same reason as that for the production of the yellow toner (1).

Thus obtained, the yellow toner (8) has D50v of 5.5 μm, GSDp of 1.23, a sphericity factor SF1 of 125, and [Fe]/[C] of 0.00013.

<Production of Magenta Toner (8)>

A magenta toner (8) was produced in the same manner as that for the yellow toner (8), for which, however, the colorant dispersion (2) was used in place of the colorant dispersion (1).

Thus obtained, the magenta toner (8) has D50v of 5.2 μm, GSDp of 1.23, a sphericity factor SF1 of 127, and [Fe]/[C] of 0.00012.

<Production of Cyan Toner (8)>

A cyan toner (8) was produced in the same manner as that for the yellow toner (8), for which, however, the colorant dispersion (3) was used in place of the colorant dispersion (1).

Thus obtained, the cyan toner (8) has D50v of 5.4 μm, GSDp of 1.22, a sphericity factor SF1 of 127, and [Fe]/[C] of 0.00015.

<Production of Black Toner (8)>

A black toner (8) was produced in the same manner as that for the yellow toner (8), for which, however, the colorant dispersion (4) was used in place of the colorant dispersion (1).

Thus obtained, the black toner (8) has D50v of 5.7 μm, GSDp of 1.23, a sphericity factor SF1 of 126, and [Fe]/[C] of 0.00012.

The particle size, GSDp, the sphericity factor and [Fe]/[C] obtained through X-ray fluorescence analysis of the toners are shown in Table 1.

TABLE 1

| Toner | D50v (μm) | GSDp | Sphericity Factor SF1 | [Fe]/[C] |
|---|---|---|---|---|
| yellow toner (1) | 5.8 | 1.20 | 130 | 0.00013 |
| yellow toner (2) | 6.0 | 1.19 | 133 | 0.00006 |
| yellow toner (3) | 5.5 | 1.21 | 136 | 0.00019 |
| yellow toner (4) | 6.0 | 1.20 | 132 | 0.00001 |
| yellow toner (5) | 5.4 | 1.19 | 135 | 0.00030 |
| yellow toner (6) | 6.5 | 1.23 | 145 | 0.00014 |
| yellow toner (7) | 7.0 | 1.24 | 147 | 0.00015 |
| yellow toner (8) | 5.5 | 1.23 | 125 | 0.00013 |
| magenta toner (1) | 5.5 | 1.19 | 137 | 0.00012 |
| magenta toner (2) | 5.7 | 1.20 | 140 | 0.00007 |
| magenta toner (3) | 5.2 | 1.20 | 132 | 0.00018 |
| magenta toner (4) | 5.7 | 1.19 | 139 | 0.00002 |
| magenta toner (5) | 5.1 | 1.22 | 133 | 0.00031 |
| magenta toner (6) | 7.0 | 1.24 | 152 | 0.00014 |

TABLE 1-continued

| Toner | D50v (μm) | GSDp | Sphericity Factor SF1 | [Fe]/[C] |
|---|---|---|---|---|
| magenta toner (7) | 7.2 | 1.25 | 154 | 0.00015 |
| magenta toner (8) | 5.2 | 1.23 | 127 | 0.00012 |
| cyan toner (1) | 5.7 | 1.19 | 135 | 0.00013 |
| cyan toner (2) | 5.9 | 1.18 | 133 | 0.00008 |
| cyan toner (3) | 5.4 | 1.20 | 140 | 0.00020 |
| cyan toner (4) | 5.9 | 1.19 | 130 | 0.00003 |
| cyan toner (5) | 5.3 | 1.22 | 133 | 0.00035 |
| cyan toner (6) | 7.3 | 1.24 | 145 | 0.00015 |
| cyan toner (7) | 6.9 | 1.24 | 154 | 0.00012 |
| cyan toner (8) | 5.4 | 1.22 | 127 | 0.00015 |
| black toner (1) | 6.0 | 1.22 | 132 | 0.00014 |
| black toner (2) | 5.2 | 1.21 | 133 | 0.00010 |
| black toner (3) | 5.7 | 1.20 | 137 | 0.00017 |
| black toner (4) | 5.5 | 1.19 | 131 | 0.00004 |
| black toner (5) | 5.6 | 1.22 | 133 | 0.00040 |
| black toner (6) | 7.4 | 1.25 | 155 | 0.00014 |
| black toner (7) | 7.2 | 1.26 | 149 | 0.00013 |
| black toner (8) | 5.7 | 1.23 | 126 | 0.00012 |

<Production of Carrier>

1000 parts of Mn—Mg ferrite (volume-average particle size 50 μm, from Powdertex) was put into a kneader, and a solution prepared by dissolving 150 parts of styrene-methyl methacrylate copolymer (polymerization ratio 40/60, Tg 90° C., weight-average molecular weight 72,000; from Soken Chemical) in 700 parts of toluene was added to it and mixed at room temperature for 20 minutes. Then, this was heated up to 70° C. and dried under reduced pressure, and taken out to obtain a coated carrier. The coated carrier was sieved through a 75 μm-mesh screen to remove coarse grains to obtain a carrier.

<Production of Developer>

The carrier and any of the yellow toners (1) to (8), the magenta toners (1) to (8), the cyan toners (1) to (8) and the black toners (1) to (8) were put into a V blender in a ratio by weight of 95/5, and stirred for 20 minutes to obtain an electrostatic latent image developer.

<Formation of Fixed Image>

The electrostatic latent image developers with any of the yellow toners (1) to (8), the magenta toners (1) to (8), the cyan toners (1) to (8) and the black toners (1) to (8) were charged in a modified machine of a processor DocuCentre Color 320CP (by Fuji Xerox) in a ratio as in Table 2 below, and the machine was so controlled that the toner amount to be on the unit area of copying paper could be 4.0 g/m$^2$. In that condition, monochromatic images of the respective colors were outputted on different sheets of copying paper. The copying paper used herein is Fuji Xerox's OHP (V516).

Table 2 shows the result of the odor and the OHP aptitude of the yellow, magenta, cyan and black toner used in Examples 1 to 6 and Comparative Examples 1 and 2. Developers were used for development, but the toners used in the developers are shown in Table 2.

TABLE 2

| | Yellow Toner | Magenta Toner | Cyan Toner | Black Toner | Odor | OHP Aptitude |
|---|---|---|---|---|---|---|
| Example 1 | (1) | (1) | (1) | (1) | A | A |
| Example 2 | (2) | (2) | (2) | (2) | B | A |
| Example 3 | (3) | (3) | (3) | (3) | A | B |
| Example 4 | (6) | (6) | (6) | (6) | B | B |

TABLE 2-continued

| | Yellow Toner | Magenta Toner | Cyan Toner | Black Toner | Odor | OHP Aptitude |
|---|---|---|---|---|---|---|
| Example 5 | (7) | (7) | (7) | (7) | B | B |
| Example 6 | (8) | (8) | (8) | (8) | B | B |
| Comparative Example 1 | (4) | (4) | (4) | (4) | C | A |
| Comparative Example 2 | (5) | (5) | (5) | (5) | A | C |

<Organoleptic Odor Test>

The developer with the toner as above was charged in a modified model of DocuCentre Color 400 and a modified model of DocuColor 1250, both Fuji Xerox's duplicators. The two modified machines were set and driven in a closed booth having a floor area of 4.5 m×4.5 m and a height of 3 m, and a chart having an image area of 20% was continuously printed to give 1,000 copies each. 20 panelists tested the copying operation for toner odor, and judged the samples. The following evaluation standards, A and B mean that the tested toners are practicable with no problem.

(Evaluation Standards in Odor Test)

A: No problem.

B: No problem in practical use, but inferior to A.

C: Impracticable.

<OHP Aptitude>

After the fixed image was formed, this was projected through a liquid-crystal projector, Fuji Xerox's XP4300JX, and evaluated its OHP capability. The following evaluation standards, A and B mean that the tested toners are practicable with no problem.

(Evaluation Standards in OHP Aptitude Test)

A: No problem.

B: No problem in practical use, but inferior to A.

C: Impracticable.

The present invention also provides an electrostatic latent image developer containing the toner; and a image formation method using the toner or the developer. Specifically, the electrostatic latent image developer and the image formation method using the toner or the developer is as follows:

An electrostatic latent image developer, including a carrier and the toner, the toner containing at least a binder resin and a colorant, wherein [Fe]/[C] satisfies the following formula (1) where [C] indicates the carbon content (%) and [Fe] indicates the iron content (%) of the toner determined through X-ray fluorescence analysis:

$$0.00005 \leqq [Fe]/[C] \leqq 0.0002 \quad (1).$$

A image formation method, which includes a step of charging a photoreceptor, a step of exposing the charged photoreceptor to light to thereby form a latent image on the photoreceptor, a step of developing the latent image with a developer to form a developed image, a step of transferring the developed image onto a transfer object, and a step of heating and fixing the developed image on a fixation substrate; wherein the developer is any of the above toner or the above electrostatic latent image developer.

The invention has made it possible to reduce the odor of a toner for electrostatic latent image development by adding a divalent iron ion to the toner.

The entire disclosure of Japanese Patent Application No. 2005-033149 filed on Feb. 9, 2005 including specification, claims, drawings and abstract is incorporated herein by reference in its entirety.

What is claimed is:

1. A toner for electrostatic latent image development, comprising a binder resin, a colorant and an iron ion reducing agent, wherein [Fe]/[C] satisfies the following formula (1):

$$0.00005 \leqq [Fe]/[C] \leqq 0.0002 \quad (1)$$

where [C] indicates a content of carbon and [Fe] indicates a content of iron in the toner determined through X-ray fluorescence analysis.

2. The toner according to claim 1, wherein the iron is divalent.

3. The toner according to claim 1, wherein the toner has a volume-average particle size of from 2 to 10 μm.

4. The toner according to claim 1, wherein the toner has GSDp of at most 1.23, which is a square root of a ratio ofD84p/D16p represented by the following formula:

$$GSDp=\{(D84p)/(D16p)\}^{0.5}$$

where D16p indicates a diameter of 16% particles, and D84p indicates a diameter of 84% particles both counted from smallest particles.

5. The toner according to claim 1, wherein the toner has a SF1 of from 110 to 140.

6. The toner according to claim 1, wherein the toner comprises the colorant in an amount of from 4% to 15% by weight relative to a total weight of a solid content of the toner.

7. The toner according to claim 1, wherein the toner comprises a lubricant in an amount of from 1 to 20% by weight relative to a total amount of the toner particles.

8. The toner according to claim 1, wherein the iron ion reducing agent is a divalent iron compound.

9. The toner according to claim 1, wherein the iron ion reducing agent is a water soluble divalent iron compound.

10. The toner according to claim 1, wherein the iron ion reducing agent is selected from the group consisting of iron (II) chloride, iron(II) bromide, iron(II) nitrate, iron(II) bicarbonate, iron(II) acetate, and iron(II) oxalate.

11. An electrostatic latent image developer comprising a binder resin, a colorant and an iron ion reducing agent, wherein [Fe]/[C] satisfies the following formula (1):

$$0.00005 \leqq [Fe]/[C] \leqq 0.0002 \quad (1)$$

where [C] indicates a content of carbon and [Fe] indicates a content of iron in the toner determined through X-ray fluorescence analysis.

12. The electrostatic latent image developer according to claim 11, wherein the toner comprises a carrier, core of the carrier having a mean particle size of from 3 times to 10 times as large as a mean particle size of the toner particles.

13. The electrostatic latent image developer according to claim 11, wherein the carrier comprises a coating resin.

14. An image formation method, comprising:

charging a photoreceptor;

exposing the charged photoreceptor to light to form a latent image on the photoreceptor;

developing the latent image with an electrostatic latent image developer to form a developed image, the developer comprising a binder resin, a colorant and an iron ion reducing agent, wherein [Fe]/[C] satisfies the following formula (1):

$$0.00005 \leqq [Fe]/[C] \leqq 0.0002 \quad (1)$$

where [C] indicates a content of carbon and [Fe] indicates a content of iron in the toner determined through X-ray fluorescence analysis;

transferring the developed image onto a transfer object; and heating and fixing the developed image on a fixation substrate.

15. The image formation method according to claim 14, wherein the photoreceptor is charged on contact electrification system.

16. The image formation method according to claim 14, wherein the developed image is transferred onto the transfer object by using one of an intermediate drum and an intermediate transfer belt.

17. The image formation method according to claim 14, wherein the developed image is transferred onto the transfer object by using one of an intermediate drum and an intermediate transfer belt.

18. The image formation method according to claim 14, wherein a fixation member used at the time of heating and fixing the developed image on the fixation substrate has a shape of a roll or a belt, at least one side of the fixation member being provided with a heating unit.

* * * * *